US005471753A

United States Patent [19]

Rodrigues

[11] Patent Number: 5,471,753

[45] Date of Patent: Dec. 5, 1995

[54] COMBINATION T-SQUARE AND CUTTER

[76] Inventor: Bernardo M. Rodrigues, 31-02 Norwood Dr., Fair Lawn, N.J. 07410

[21] Appl. No.: 235,471

[22] Filed: Apr. 29, 1994

[51] Int. Cl.[6] ..... B26B 29/06

[52] U.S. Cl. ..... 33/42; 33/485; 30/293

[58] Field of Search ..... 33/42, 468, 479, 33/485; 7/163; 83/468, 614; 30/164.95, 292, 293, 294

[56] References Cited

U.S. PATENT DOCUMENTS

| | | | |
|---|---|---|---|
| 1,445,546 | 2/1923 | Olson | 33/42 |
| 2,835,037 | 5/1958 | Middents | 33/485 |
| 3,286,351 | 11/1966 | McAlister | 33/42 |
| 3,439,426 | 4/1969 | Wilson | 7/163 |
| 4,903,409 | 2/1990 | Kaplan et al. | 30/293 |
| 4,949,462 | 8/1990 | Spencer | 33/42 |
| 4,979,304 | 12/1990 | Sprague | 30/293 |
| 5,033,197 | 7/1991 | Irvello | 33/42 |
| 5,083,375 | 2/1992 | Helm, Jr. | 33/42 |
| 5,309,642 | 5/1994 | McGinnis | 83/614 |

*Primary Examiner*—Thomas B. Will

[57] ABSTRACT

A combination T square and cutter comprising a main segment formed in a long planar rectangular configuration with parallel long side edges and parallel short side edges. The main segment includes a centrally located long rectangular aperture which extends the majority of the length of its long sides. The long side edges of the aperture include an undercut groove. A cross bar is formed in a planar rectangular configuration with parallel short edges and parallel long edges. The central portion of the bar is coupled to the lower surface of the main segment. A slide base is formed in a planar rectangular configuration with parallel long edges, parallel short edges, an upper surface and a lower surface. The short edges of the base are adapted to fit within the grooves in the aperture of the main segment. The base includes a coupling device on its upper surface. A knife holder is formed in a curved boat-like configuration with upwardly extending side walls, one large open end, one smaller closed end, and an open top portion therebetween. The holder is formed in a downwardly angled configuration with the small end positioned at the lower end. The small end also includes a slot extending from its edge downward a short distance. The holder is positioned upon the slide base and includes a coupling device at its lowermost extent which permits rotation and locking of the holder.

4 Claims, 4 Drawing Sheets

COMBINATION T-SQUARE AND CUTTER

BACKGROUND OF THE INVENTION

1. Field of the Invention

The present invention relates to a combination T-square and cutter and more particularly pertains to aiding users in making horizontal and vertical straight cuts on a wide variety of materials.

2. Description of the Prior Art

The use of T-squares is known in the prior art. More specifically, T-squares heretofore devised and utilized for the purpose of measuring and marking materials are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,162,578 to Astarita a T-square.

U.S. Pat. No. 4,635,377 to Park discloses a T-square apparatus.

U.S. Pat. No. 4,312,133 to Mima discloses a T-square.

U.S. Pat. No. 5,040,297 to Scheinost discloses a fiberglass panel cutter with adjustable square and duct knife.

Lastly, U. S. Pat. No. 4,525,933 to Patterson discloses an adjustable T-square.

In this respect, the combination T-square and cutter according to the present invention substantially departs from the conventional concepts and designs of the prior art, and in doing so provides an apparatus primarily developed for the purpose of aiding users in making horizontal and vertical straight cuts on a wide variety of materials.

Therefore, it can be appreciated that there exists a continuing need for a new and improved combination T-square and cutter which can be used for aiding users in making horizontal and vertical straight cuts on a wide variety of materials. In this regard, the present invention substantially fulfills this need.

SUMMARY OF THE INVENTION

In view of the foregoing disadvantages inherent in the known types of T-squares now present in the prior art, the present invention provides an improved combination T-square and cutter. As such, the general purpose of the present invention, which will be described subsequently in greater detail, is to provide a new and improved combination T-square and cutter and method which has all the advantages of the prior art and none of the disadvantages.

To attain this, the present invention essentially comprises a main segment formed in a long generally rectangular configuration. The main segment includes parallel long side edges, parallel short interior and exterior edges, an interior section and an exterior section. The main segment has an upper surface and a lower surface. The interior section measures a short distance and includes a plurality of circular holes near its uppermost extent. The exterior section is imperforate. The remainder of the main segment includes a centrally located, generally rectangular shaped aperture with parallel long side edges and parallel short side edges. The aperture begins a short distance from the interior section and extends to a point near the exterior section of the main segment. The upper surface of the long side edges of the aperture include a plurality of equidistantly spaced generally triangular shaped concave notches. The lower surface of the main segment is divided into two zones. Each zone is defined by the distance between the long edge of the aperture and the long edge of the main segment. Each zone has an upwardly extending groove with a bearing surface inboardly, an undercut region thereabove and a vertical wall outboardly. A cross bar is formed in a generally planar rectangular configuration with parallel short edges and parallel front and rear edges defining an interior end and an exterior end of the bar. The central portion of the bar includes a plurality of circular holes. A plurality of screws are adapted to couple the bar to the upper surface of the interior section of the main segment through their aligned screw holes. A slide base is formed in a generally planar rectangular configuration with parallel long edges, parallel short edges, an upper surface and a lower surface. The short edges of the lower surface include two contiguously formed, upwardly extending inverted L-shaped members with horizontal segments which extend toward the center point of the upper surface. A roller and its associated axle are positioned between the horizontal portion of the L-shaped member and the horizontal upper surface of the base. The roller is shaped in a generally cylindrical configuration with a concave sidewall and a hole through its axis. The axle extends vertically through the roller with its ends coupled to each of the horizontal surfaces. The upper surface has a centrally located circular hole. The upper surface also includes a generally solid cylindrical support positioned thereupon. The support has an upper surface and a lower surface with a centrally located circular hole extending therethrough. The support has a diameter about equal to the length of the short sides. The hole in the support is aligned with the hole in the base. The support has a height about equal to the width of the main segment. The base is adapted to be positioned within the zones in the lower surface of the main segment with each of its rollers positioned on the bearing surfaces. The base is adapted to slide along the bearing surface on the lower surface of the main segment. A knife holder has an upper section and a lower section. The lower section is formed in a generally rectangular configuration with an upper surface and a lower surface. The lower surface includes a centrally located hole with internal screw threads and is positioned upon the upper surface of the cylindrical support with the holes in vertical alignment. Two side edges of the lower section each include a pair of triangular shaped extensions adapted to couple within the notches in the upper surface of the lower section. The lower section having a plane angled upwardly toward its center to form the lower extent of the upper section. The upper section is formed in a curved boat-like configuration with upwardly extending side walls, one large open end, one smaller closed end, and an open top portion therebetween. The upper section is formed in a downwardly angled configuration with the small end positioned at the lower end. The small end also includes a centrally located, generally vertically oriented slot which extends from its open end downward a short distance. The holder is adapted to support a standard sheet rock knife with the blade extending through the slot in the small end. A compression screw is formed in a generally cylindrical configuration and is positioned vertically in the operative orientation. The lower extent of the screw includes a planar head. The upper portion of the screw includes external screw threads near its uppermost extent. The central portion therebetween has a smooth surface. The screw includes a spring positioned around its entire extent. The screw is adapted to couple the slide base, cylindrical support and knife holder through their aligned circular holes. The upper extent of the screw is securely coupled into the lower surface of the holder with the spring being compressed within the cylindrical support in the operative orientation. The compression spring includes a locking mechanism and is adapted to permit circular rotation of the knife holder upon the slide base.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved combination T-square and cutter which has all the advantages of the prior art T-squares and none of the disadvantages.

It is another object of the present invention to provide a new and improved combination T-square and cutter which may be easily and efficiently manufactured and marketed.

It is further object of the present invention to provide a new and improved combination T-square and cutter which is of durable and reliable constructions.

An even further object of the present invention is to provide a new and improved combination T-square and cutter which is susceptible of a low cost of manufacture with regard to both materials and labor, and which accordingly are then susceptible of low prices of sale to the consuming public, thereby making such combination T-square and cutter economically available to the buying public.

Still yet another object of the present invention is to provide a new and improved combination T-square and cutter which provides in the apparatuses and methods of the prior art some of the advantages thereof, while simultaneously overcoming some of the disadvantages normally associated therewith.

Still another object of the present invention is to aid users in making horizontal and vertical straight cuts on a wide variety of materials.

Lastly, it is an object of the present invention to provide a new and improved combination T square and cutter comprising a main segment formed in a long planar rectangular configuration with parallel long side edges and parallel short side edges. The main segment includes a centrally located long rectangular aperture which extends the majority of the length of its long sides. The long side edges of the aperture include an undercut groove. A cross bar is formed in a planar rectangular configuration with parallel short edges and parallel long edges. The central portion of the bar is coupled to the lower surface of the main segment. A slide base is formed in a planar rectangular configuration with parallel long edges, parallel short edges, an upper surface and a lower surface. The short edges of the base are adapted to fit within the grooves in the aperture of the main segment. The base includes a coupling device on its upper surface. A knife holder is formed in a curved boat-like configuration with upwardly extending side walls, one large open end, one smaller closed end, and an open top portion therebetween. The holder is formed in a downwardly angled configuration with the small end positioned at the lower end. The small end also includes a slot extending from its edge downward a short distance. The holder is positioned upon the slide base and includes a coupling device at its lowermost extent which permits rotation and locking of the holder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
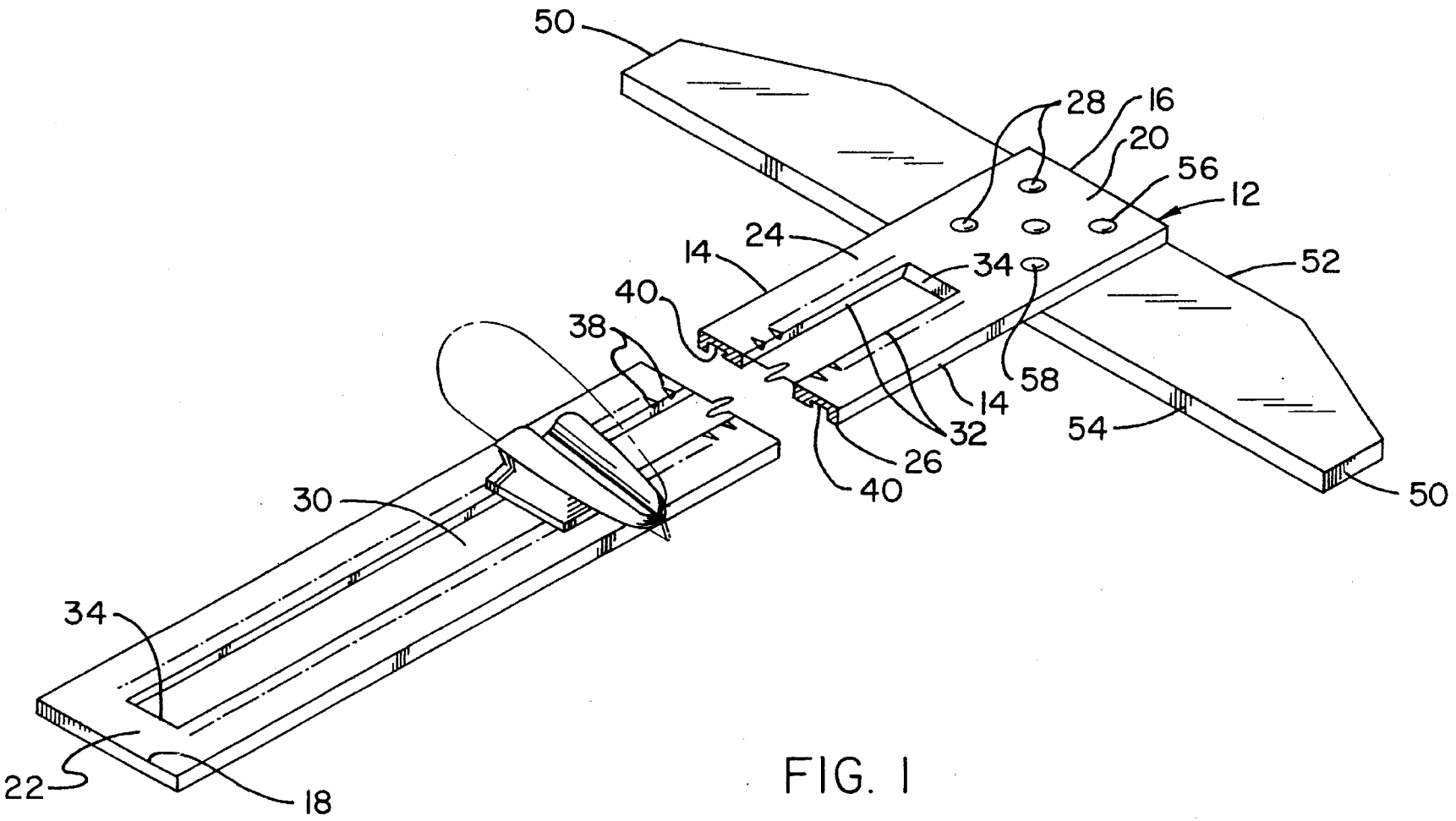
FIG. 1 is a perspective view of the preferred embodiment of the combination T-square and cutter constructed in accordance with the principles of the present invention.
Figure 2:
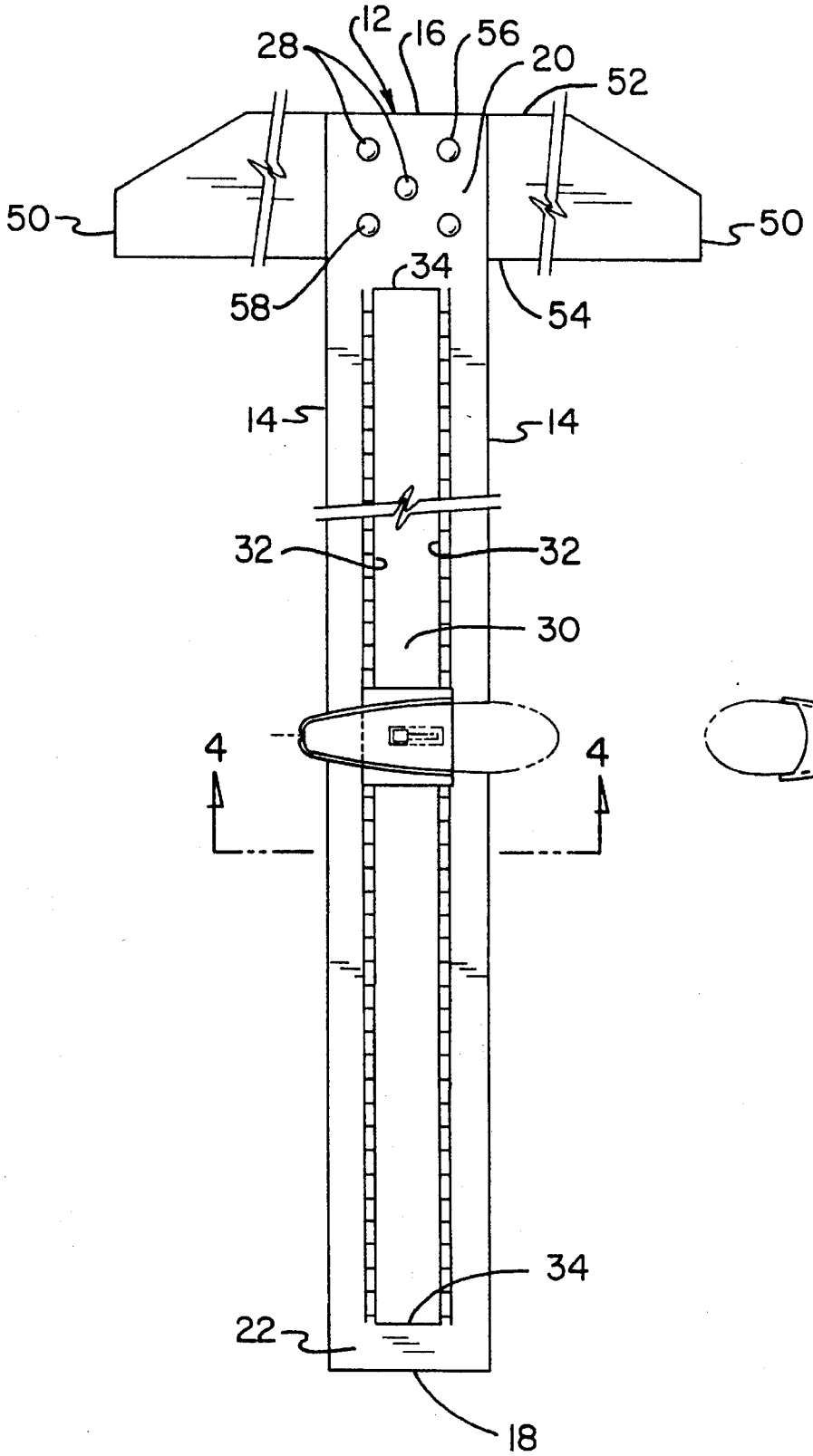
FIG. 2 is a top plan view of the apparatus shown in FIG. 1.
Figure 3:
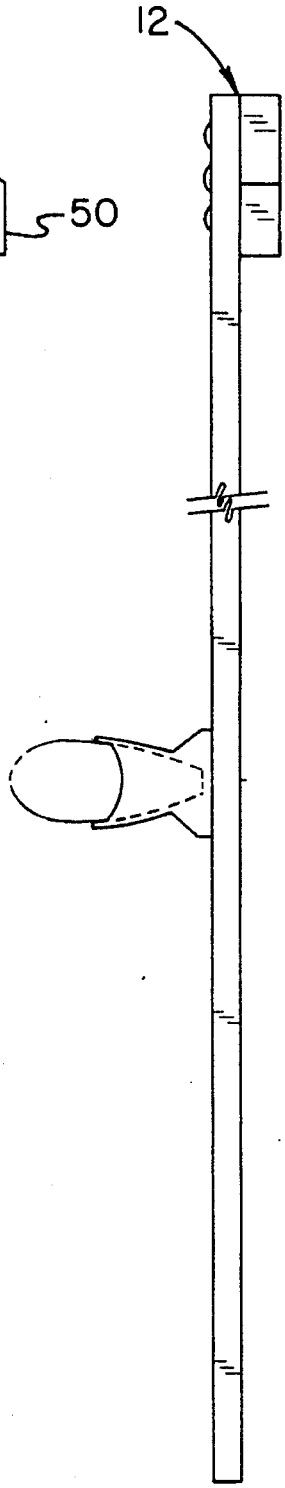
FIG. 3 is a slide elevational view of the apparatus shown in FIG. 1.
Figure 4:
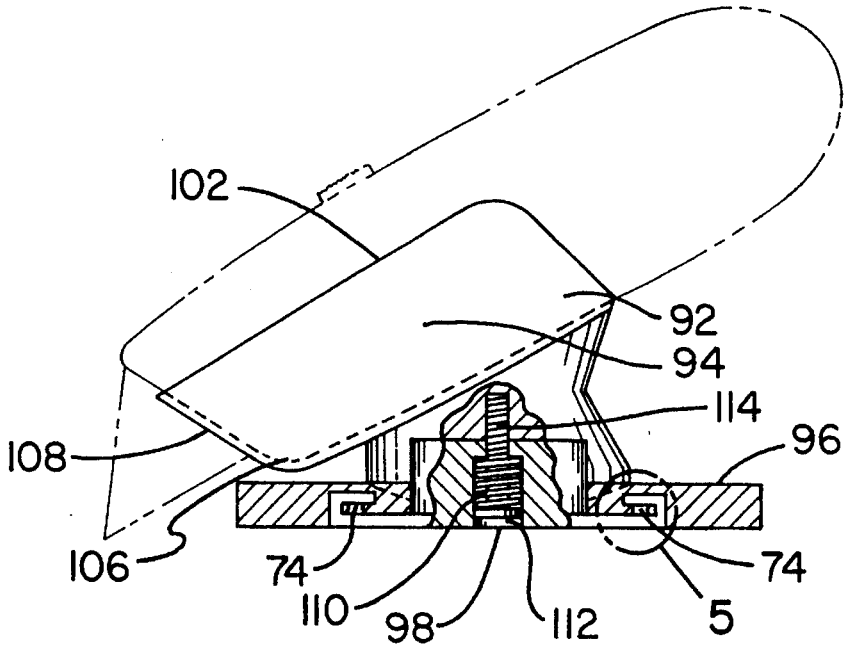
FIG. 4 is a cross sectional view taken along line 4—4 of FIG. 2 illustrating the holder, slide base and compression screw.
Figure 5:
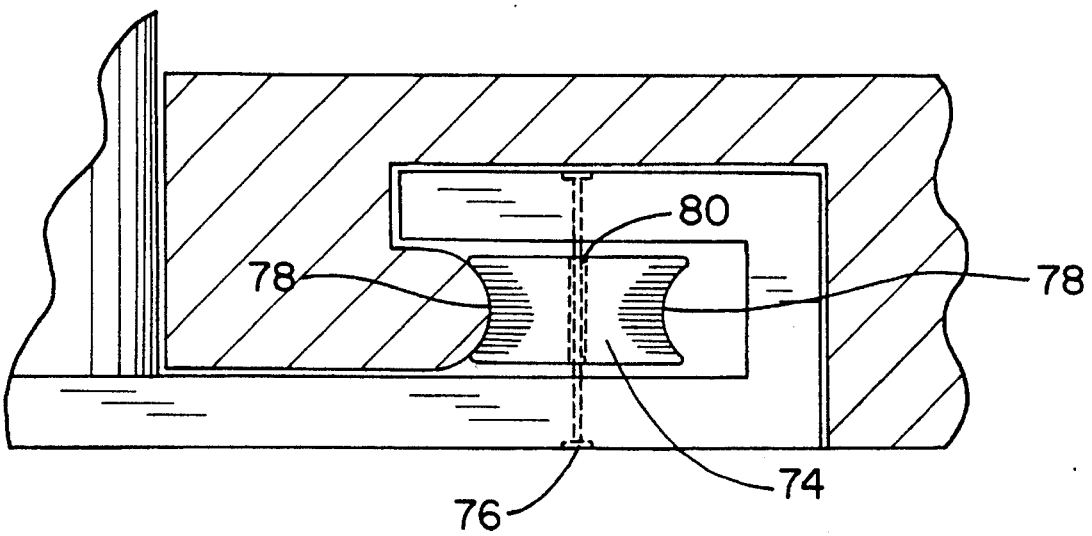
FIG. 5 is an exploded cross sectional view taken along line 5—5 of FIG. 4 illustrating the roller positioned within the inverted L-shaped member.
Figure 6:
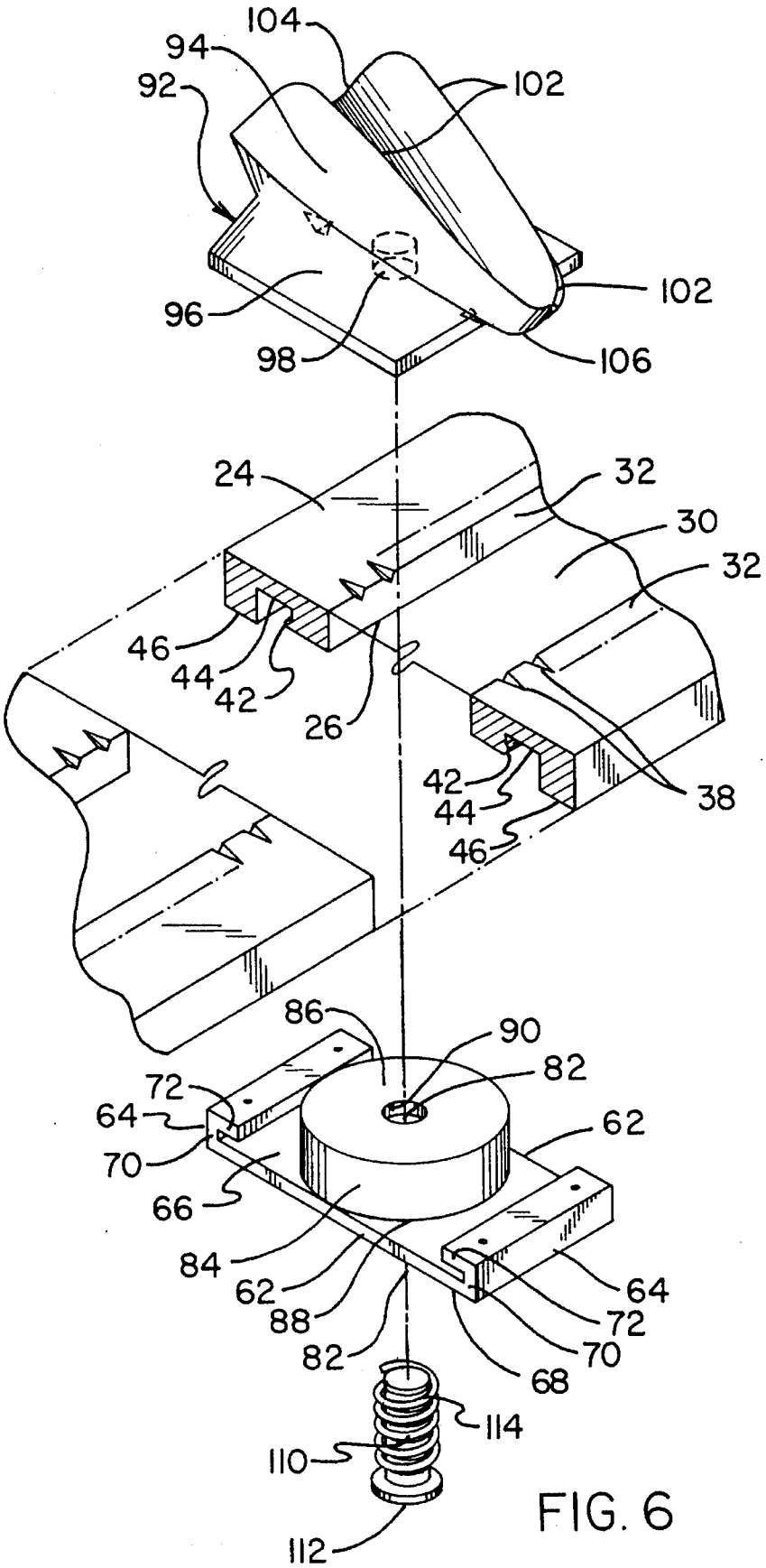
FIG. 6 is an exploded, separated perspective view of the main segment, holder, slide base and compression screw.

With reference now to the drawings, and in particular to FIG. 1 thereof, the preferred embodiment of the new and improved combination T-square and cutter embodying the principles and concepts of the present invention and generally designated by the reference numeral 10 will be described.

Specifically, it will be noted in FIGS. 1 through 6, that there is provided a new and improved combination T-square and cutter. The combination T-square and cutter 10, in its broadest context, comprises a main segment 12, a cross bar 48, a slide base 60, a knife holder 92 and a compression screw 110.

More specifically, the main segment 12 includes parallel long side edges 14, parallel short interior 16 and exterior 18 edges, an interior section 20 and an exterior section 22. The main segment 12 has an upper surface 24 and a lower surface 26. The interior section 20 measures a short distance and includes a plurality of circular holes 28 near its uppermost extent. The exterior section 22 is imperforate. The main segment is adapted to lie horizontally upon the desired cutting surface. Note FIGS. 1 and 2.

The remainder of the main segment 12 includes a centrally located, generally rectangular shaped aperture 30 with parallel long side edges 32 and parallel short side edges 34. The aperture 30 begins a short distance from the interior section 20 and extends to a point near the exterior section 22 of the main segment 12. The upper surface of the long side edges 32 of the aperture include a plurality of equidistantly spaced generally triangular shaped concave notches 38. The long edges of the aperture may include an imprinted linear scale which is graduated in inches or metric measurements. The lower surface of the main segment is divided into two zones 40. Each zone 40 is defined by the distance between the long edge of the aperture and the long edge of the main segment. Each zone 40 has an upwardly extending groove with a bearing surface inboardly 42, an undercut region 44 thereabove and a vertical wall outboardly 46. The bearing surface is shaped in a rounded semi-circular configuration. Note FIG. 6.

The second component of the apparatus is a cross bar 48 formed in a generally planar rectangular configuration with parallel short edges 50 and parallel front 52 and rear edges 54 defining an interior end and an exterior end of the bar. The central portion of the bar includes a plurality of circular holes 56. A plurality of screws 58 are adapted to couple the bar to the upper surface of the interior section of the main segment through their aligned screw holes. The cross bar is adapted to be positioned along a linear edge of a piece of material to be cut. Note FIGS. 1 and 2.

The third component of the apparatus is the slide base 60 which is formed in a generally planar rectangular configuration with parallel long edges 62, parallel short edges 64, an upper surface 66 and a lower surface 68. The short edges 64 of the lower surface include two contiguously formed, upwardly extending inverted L-shaped members 70 with horizontal segments 72 which extend toward the center point of the upper surface. The horizontal segment lies parallel to the plane of the upper surface. Note FIGS. 4 and 6.

A roller 74 and its associated axle 76 are positioned between the horizontal portion of the L-shaped member 70 and the horizontal upper surface 66 of the base. The roller 74 is shaped in a generally cylindrical configuration with a concave sidewall 78 and a hole through its axis 80. The axle 76 extends vertically through the roller with its ends coupled to each of the horizontal surfaces. The rollers are to spin when moved along the bearing surface in the aperture of the main segment. Note FIG. 5.

The upper surface 66 of the base has a centrally located circular hole 82. The upper surface 66 also includes a generally solid cylindrical support 84 positioned thereupon. The support 84 has an upper surface 86 and a lower surface 88 with a centrally located circular hole 90 extending therethrough. The support 84 has a diameter about equal to the length of the short sides. The hole 90 in the support is aligned with the hole in the base 82. The upper surface of the support is positioned at the same height as the plane of the upper surface of the main segment 12. The base 60 is adapted to be positioned within the zones in the lower surface of the main segment with each of its rollers positioned on the bearing surfaces 42. The base 60 is adapted to slide along the bearing surface 42 on the lower surface of the main segment. The roller in the base enables the user to easily move the base and lock it into a desired position by securing the extensions within the notches in the main segment. Note FIGS. 1 and 6.

The fourth component of the apparatus is a knife holder 92 which has an upper section 94 and a lower section 96. The lower section is formed in a generally rectangular configuration with an upper surface and a lower surface. The lower surface 96 includes a centrally located hole 98 with internal screw threads and is positioned upon the upper surface 86 of the cylindrical support with the holes in vertical alignment. Two side edges of the lower section each include a pair of triangular shaped extensions 100 adapted to couple within the notches 38 in the upper surface of the lower section. The lower section 96 having a plane angled upwardly toward its center to form the lower extent of the upper section. The holder is angled downwardly so that a knife mounted within the holder will extend down to the desired cutting surface. Note FIGS. 3, 4 and 6.

The upper section 94 is formed in a curved boat-like configuration with upwardly extending side walls 102, one large open end 104, one smaller closed end 106, and an open top portion therebetween. The upper section 94 is formed in a downwardly angled configuration with the small end 106 positioned at the lower end. The small end 106 also includes a centrally located, generally vertically oriented slot 108 which extends from its open end downward a short distance. The holder 92 is adapted to support a standard sheet rock knife with the blade extending through the slot 108 in the small end 106. The slot permits the knife blade to extend down to the cutting surface. Note FIG. 4.

A compression screw 110 is formed in a generally cylindrical configuration and is positioned vertically in the operative orientation. The lower extent of the screw includes a planar head 112. The upper portion of the screw includes external screw threads 114 near its uppermost extent. The central portion therebetween has a smooth surface. The screw includes a spring 116 positioned around its entire extent. The screw 110 is adapted to couple the slide base, cylindrical support and knife holder through their aligned circular holes. The upper extent of the screw 110 is securely coupled into the lower surface of the holder 96 with the spring 116 being compressed within the cylindrical support in the operative orientation. Note FIG. 4. The compression spring includes a locking mechanism and is adapted to permit circular rotation of the knife holder upon the slide base. The knife may be rotated in a range of three hundred and sixty degrees to enable a user to make vertical and horizontal cuts. Note FIGS. 4 and 6.

The combination T-square and cutter combines the capabilities of a T-square and a utility knife of the type generally used to cut sheet rock and other materials. It is simply comprised of a large T-square, a knife holder and a slide base. The T-square is conventional except that a centrally located aperture is present in the main segment. The main segment also includes recessed slots in its bottom edge.

The knife holder is positioned on a slide base which includes a centrally positioned compression spring. The slide base is guided by, and slides snugly within the recesses in the main segment. A knife is angularly mounted within the holder. The knife can be rotated so that its cutting edge extends through the center of the aperture or over the edge of the main segment.

Both horizontal and vertical straight cuts can be made with no prior marking of the material. To make a vertical cut, i.e., one along the plane of the extension arm, one simply rotates the knife so that the blade is central with the slot. One then slides the knife holder along the slot while holding the cross bar stationary.

Inversely, horizontal cuts can be made with the knife blade extending over the edge of the extension. This is accomplished by locking the holder and moving the entire apparatus across the material while the main segment contacts the straight edge of the material. Note that no prior marking of the material is required for this latter type of cut since the scale can be used to positioned the knife. The combination T-square is designed for use by anyone having the need to cut any type of panel material, be they amateur or professional.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved combination T square and cutter comprising, in combination:

a main segment formed in a long generally rectangular configuration with parallel long side edges, parallel short interior and exterior edges, an interior section and an exterior section, the main segment having an upper surface and a lower surface, the interior section measuring a short distance and including a plurality of circular holes near its uppermost extent, the exterior section being imperforate with the remainder of the main segment including a centrally located generally rectangular shaped aperture with parallel long side edges and parallel short side edges, the aperture beginning a short distance from the interior section and extending to a point near the exterior section of the main segment, the upper surface of the long side edges of the aperture including a plurality of equidistantly spaced generally triangular shaped concave notches, the lower surface of the main segment being divided into two zones, each zone being defined by the distance between the long edge of the aperture and the long edge of the main segment, each zone having an upwardly extending groove with a bearing surface inboardly, an undercut region thereabove and a vertical wall outboardly;

a cross bar formed in a generally planar rectangular configuration with parallel short edges and parallel front and rear edges defining an interior end and an exterior end of the bar, the central portion of the bar including a plurality of circular holes, a plurality of screws being adapted to couple the bar to the upper surface of the interior section of the main segment through their aligned holes;

a slide base formed in a generally planar rectangular configuration with parallel long edges, parallel short edges, an upper surface and a lower surface, each of the short edges of the lower surface including a contiguously formed, upwardly extending inverted L-shaped member with a horizontal segment which extends toward the center point of the upper surface, a roller and its associated axle being positioned between each of the horizontal portions of the L-shaped members and the horizontal upper surface of the base, each of the rollers being shaped in a generally cylindrical configuration with a concave sidewall and a hole through its axis, the axle extending vertically through the roller with its ends coupled to each of the horizontal surfaces, the upper surface having a centrally located circular hole, the upper surface also including a generally solid cylindrical support positioned thereupon, the support having an upper surface and a lower surface with a centrally located circular hole extending therethrough, the support having a diameter about equal to the length of the short sides, with the hole in the support being aligned with the hole in the base, the support having a height about equal to the width of the main segment, the base adapted to be positioned within the zones in the lower surface of the main segment with each of its rollers positioned on the bearing surfaces, the base adapted to slide along the bearing surface on the lower surface of the main segment;

a knife holder having an upper section and a lower section, the lower section formed in a generally rectangular configuration with an upper surface and a lower surface, the lower surface including a centrally located hole with internal screw threads and being positioned upon the upper surface of the cylindrical support with the holes in vertical alignment, with two side edges of the lower section each including a pair of triangular shaped extensions adapted to couple within the notches in the upper surface of the exterior section, the lower section having a plane angled upwardly toward its center to form the lower extent of the upper section, the upper section being formed in a curved boat-like configuration with upwardly extending side walls, one large open end, one smaller closed end, and an open top portion therebetween, the upper section being formed in a downwardly angled configuration with the small end positioned at the lower end, the small end including a centrally located generally vertically oriented slot extending from its open end downward a short distance, the holder adapted to support a standard sheet rock knife with the blade extending through the slot in the small end; and a compression screw formed in a generally cylindrical configuration and positioned vertically in the operative orientation, the lower extent of the screw including a planar head, the upper portion of the screw including external screw threads near its uppermost extent, the central portion therebetween having a smooth surface, the screw including a spring positioned around its entire extent, the screw adapted to couple the slide base, cylindrical support and knife holder through their aligned circular holes, the upper extent of the screw being securely coupled into the lower surface of the holder with the spring being compressed within the cylindrical support in the operative orientation, the compression spring including a locking mechanism and adapted to permit circular rotation of the knife holder upon the slide base.

2. A combination T square and cutter comprising:

a main segment formed in a long planar rectangular configuration with parallel long side edges and parallel short side edges, the main segment including a centrally located long rectangular aperture extending the majority of the length of its long sides edges and an undercut groove formed in each section defined between the long side edges and the aperture;

a cross bar formed in a planar rectangular configuration with parallel short edges and parallel long edges, means for coupling a central portion of the bar to the lower surface of the main segment;

a slide base formed in a planar rectangular configuration with parallel long edges, parallel short edges, an upper surface and a lower surface, the short edges of the base including means adapted to fit within the undercut grooves in the main segment, the base including a support on its upper surface;

a knife holder formed in a curved boat-like configuration with upwardly extending side walls, one large open end, one smaller closed end, and an open top portion therebetween, the holder being formed in a downwardly angled configuration with the small end positioned at the lower end, the small end including a centrally located slot extending from its edge downward a short distance, the holder being positioned upon the support of the slide base; and a coupling device for coupling the knife holder to the slide base and permitting rotation and locking of the holder to the base.

3. The apparatus as set forth in claim 2 wherein each of the means adapted to fit within the undercut grooves includes rollers.

4. The apparatus as set forth in claim 2 wherein the coupling device is a compression screw, the compression screw consisting of a screw with a planar head and external screw threads, with a spring positioned therearound.

* * * * *